US011339977B2

(12) United States Patent
Devrath et al.

(10) Patent No.: US 11,339,977 B2
(45) Date of Patent: May 24, 2022

(54) APPARATUS AND METHOD FOR PROVIDING ADEQUATE COOLING INSIDE AN ELECTRICAL EQUIPMENT

(71) Applicant: Carrier Corporation, Palm Beach Gardens, FL (US)

(72) Inventors: Mani Ram Devrath, Haryana (IN); Dinesh Dudeja, Haryana (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/007,377

(22) Filed: Aug. 31, 2020

(65) Prior Publication Data

US 2021/0071882 A1 Mar. 11, 2021

(30) Foreign Application Priority Data

Sep. 6, 2019 (IN) ..... 201911036043

(51) Int. Cl.
*F24F 1/22* (2011.01)
*F24F 1/50* (2011.01)
*F24F 1/24* (2011.01)

(52) U.S. Cl.
CPC ..... *F24F 1/22* (2013.01); *F24F 1/24* (2013.01); *F24F 1/50* (2013.01)

(58) Field of Classification Search
CPC ..... F24F 1/22; F24F 1/50; F24F 1/24; F24F 1/48
USPC ..... 62/259.2
See application file for complete search history.

(56) References Cited

U.S. PATENT DOCUMENTS

| | | | | |
|---|---|---|---|---|
| 8,978,393 | B2 | 3/2015 | Hika et al. | |
| 9,516,786 | B2 | 12/2016 | Lan et al. | |
| 2009/0133423 | A1 | 5/2009 | Jang et al. | |
| 2013/0255932 | A1* | 10/2013 | Doepker | F28D 15/00 165/287 |
| 2015/0204599 | A1 | 7/2015 | Chisaki et al. | |
| 2017/0130975 | A1* | 5/2017 | Shoemaker | F24F 1/24 |

FOREIGN PATENT DOCUMENTS

| | | | |
|---|---|---|---|
| CN | 1088175 | C | 7/2002 |
| CN | 2722106 | Y | 8/2005 |
| CN | 101769567 | B | 3/2013 |
| CN | 101586844 | B | 4/2013 |
| CN | 107477712 | A | 12/2017 |
| CN | 207019199 | U | 2/2018 |
| CN | 207146805 | U | 3/2018 |

(Continued)

*Primary Examiner* — Steve S Tanenbaum
(74) *Attorney, Agent, or Firm* — Cantor Colburn LLP

(57) ABSTRACT

An apparatus and a method for providing adequate cooling inside control box of an electrical equipment. A method includes receiving air from one or more air ducts in a first section wherein the first section is coupled with the one or more air ducts. The method also includes providing the air to a first fan associated with the first section and transferring the air by the first fan to one or more second fans. The method further includes receiving air from the one or more air ducts associated with the first section to one or more vents in the second section and transferring the air from one or more vents to the one or more louvers and the first fan. Air transferred to the one or more louvers and the first fan is further transferred to the one or more second fans.

20 Claims, 8 Drawing Sheets

Air flow path : air duct (102) ⟶ air vents (104) ⟶ louvers (106) ⟶ Second fan (110)

(56) References Cited

FOREIGN PATENT DOCUMENTS

| | | | | | |
|---|---|---|---|---|---|
| CN | 109084381 | A | | 12/2018 | |
| CN | 109210641 | A | | 1/2019 | |
| CN | 209042606 | U | | 6/2019 | |
| EP | 1684022 | A1 | | 7/2006 | |
| EP | 2146151 | A1 | | 1/2010 | |
| KR | 100765197 | B1 | | 10/2007 | |
| WO | WO-2017022023 | A1 | * | 2/2017 | ..... F24F 1/24 |

* cited by examiner

Air flow path : air duct (102) ⟶ first fan (108) ⟶ second fan (110)

Air flow path : air duct (102) ⟶ air vents (104) ⟶ louvers (106) ⟶ Second fan (110)

Air flow path : air duct (102) ⟶ air vents (104) ⟶ first fan (108) ⟶ Second fan (110)

APPARATUS AND METHOD FOR PROVIDING ADEQUATE COOLING INSIDE AN ELECTRICAL EQUIPMENT

FOREIGN PRIORITY

This application claims priority to Indian Patent Application No. 201911036043, filed Sep. 6, 2019, and all the benefits accruing therefrom under 35 U.S.C. § 119, the contents of which in its entirety are herein incorporated by reference.

TECHNICAL FIELD OF INVENTION

The present invention relates generally to industrial equipments. More particularly, the invention relates to an apparatus and a method for providing adequate cooling inside electrical and electronic equipments.

BACKGROUND OF THE INVENTION

Generally electrical equipment consists of a control box having various electrical components such as a circuit board, switches, an inverter circuit, a capacitor bank, motor drives, an electromagnetic interference (EMI) filter, reactors, terminal blocks, contactors, transformers, transistors, compressors and the like for controlling and working of the equipment. The control box usually consists of an electronic components along with the heat sink. The heat sink is used to expel the heat generated by the electronic components.

When the equipment operates, the electronic components present therein generate heat. Also, the control box is usually enclosed to protect the electronic components from dust and water when the box is installed in outdoor units. Another reason for providing a closed control box is to prevent the spread of fire in the electronic components. This leads to a further increase in temperature within the control box as the heat is not able to escape externally. Due to insufficient cooling, the heat within the enclosed box increases the temperature of the box leading to a rise in the temperature of the electronic components. When the temperature of the electronic components, goes beyond a specified limit, it adversely affects the life as well as the efficiency of the electronic components thereby affecting the performance of the equipment. It may even lead to failure or malfunctioning of the equipment and/or frequent power trips, thereby hampering routine work in an establishment.

In view of the aforementioned problems, there is a need in the art for an effective and efficient means for providing adequate cooling inside the control box of any electrical equipment. In order to solve these problems, an apparatus and a method are disclosed.

SUMMARY OF THE INVENTION

Various embodiments of the invention describe an apparatus and a method for providing adequate cooling inside a control box of an electrical equipment. The invention discloses an outdoor unit comprising a first section and a second section. The first section coupled with one or more air ducts is configured to provide air to a first fan associated with the first section. The air is then transferred by the first fan to one or more second fans defining a first air flow path. The second section comprises of one or more vents and one or more louvers. The one or more vents are configured to receive air from the one or more air ducts associated with the first section and transferring air through one or more louvers and further to the one or more second fans defining a second air flow path. The air through the air vents is also transferred to the first fan and is further transferred to the one or more second fans defining a third air flow path.

In another embodiment of the invention, the first section corresponds to a heat sink and the second section corresponds to electronic components of the outdoor unit.

In another embodiment of the invention, the one or more second fans are associated with a third section of the outdoor unit.

In yet another embodiment of the invention, the third section corresponds to an outdoor section for expelling out the air received from the first section and the second section.

In still another embodiment, the expelling the air from the third section lowers temperature inside the first section and the second section of the outdoor unit.

In an embodiment of the invention, the first section and the second section are encapsulated inside a box of the outdoor unit.

In another embodiment of the invention, the one or more air ducts receive an ambient air from the environment.

In another different embodiment of the invention, number of the one or more vents in the second section are 4-8.

In yet another embodiment of the invention, the one or more louvers are present on two opposite faces of the second section.

In still another embodiment of the invention, the second section is covered by a cover plate.

In an embodiment of the invention, the one or more air ducts are present at the lower end of the outdoor unit.

In yet another embodiment of the invention, a method for providing adequate cooling inside control box of an electrical equipment is disclosed. The method comprises defining a first, second, and third air flow paths. The first air flow path is defined by receiving air from one or more air ducts in a first section, the first section being coupled with the one or more air ducts, supplying air to a first fan associated with the first section and transferring the air by the first fan to one or more second fans. The second air flow path is defined by receiving air from the one or more air ducts associated with the first section to one or more vents in a second section and transferring the air from one or more vents to the one or more louvers. The air from one or more louvers is transferred to one or more second fans. The method further describes defining a third air flow path by receiving air from the one or more air ducts associated with the first section to one or more vents to the first fan and transferring air from the first fan to the one or more second fans.

In still another embodiment of the invention, the first section corresponds to a heat sink and the second section corresponds to electronic components of an outdoor unit.

In an embodiment of the invention, the one or more second fans are associated with a third section of the outdoor unit.

In another embodiment of the invention, the third section corresponds to an outdoor section for expelling out the air received from the first section and the second section.

In another different embodiment of the invention, the expelling the air from the third section lowers temperature inside a box of the outdoor unit.

In yet another different embodiment of the invention, the first section and the second section are encapsulated inside the box of the outdoor unit.

In an embodiment of the invention, the air duct receives an ambient air from the environment.

In another embodiment of the invention, number of the one or more vents in the second section are 4-8.

In yet another embodiment of the invention, the one or more louvers are present on two opposite faces of the second section.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

Corresponding reference numerals indicate corresponding parts throughout the drawings.

DETAILED DESCRIPTION OF THE INVENTION

Figure 1:
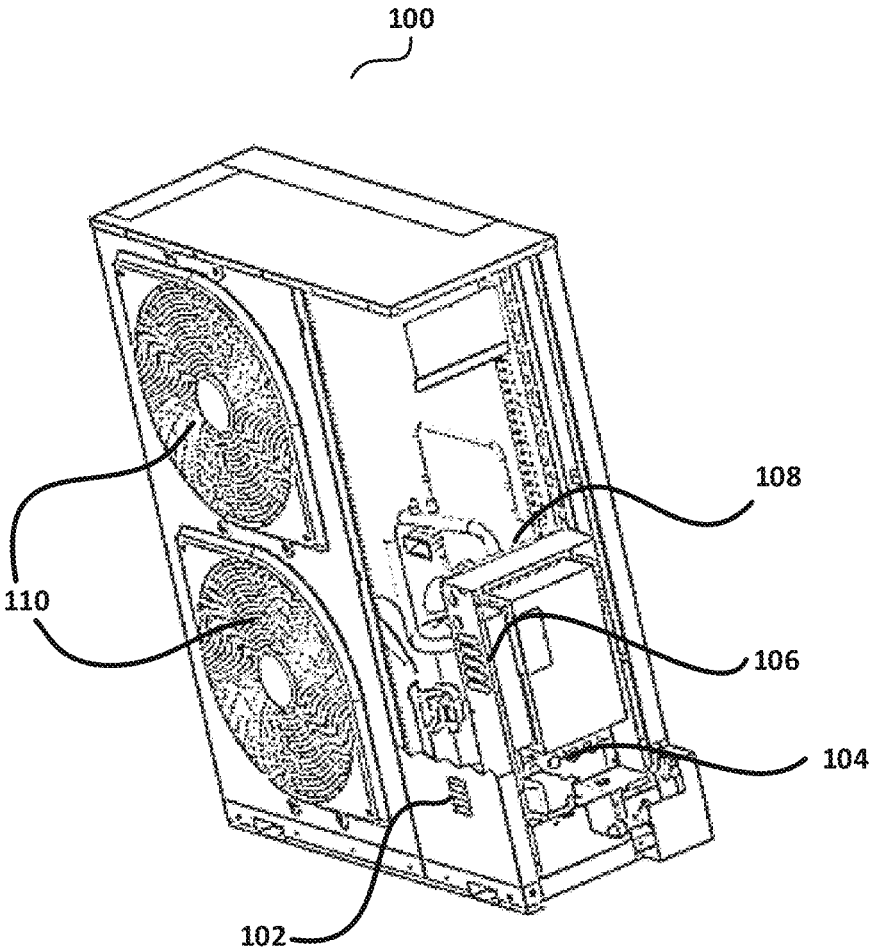
FIG. 1 is an exemplary diagram depicting an outdoor unit in accordance with an exemplary embodiment of the invention.

Described herein is an apparatus and a method for providing adequate cooling inside a control box of an electrical equipment. In different embodiments of the invention, an outdoor unit of an electrical equipment comprising a control box is disclosed. The invention further describes the various sections—a first section, a second section and a third section of the outdoor unit. The first section corresponds to a heat sink, the second section corresponds to an electronic component section and the third section corresponds to an outdoor section or exhaust section. The first and the second section are encapsulated inside the control box of the outdoor unit. The unit is designed in a manner so as to include an air duct, air vents and louvers that help in lowering the temperature within the closed control box of the outdoor unit by providing an optimum air flow. This aids in preventing overheating of the electronic components of the said electrical equipment and consequent failure and/or malfunctioning of the equipment.

Various embodiments of the invention describe the heat sink or the first section coupled with one or more air ducts to provide air to a first fan associated with the first section. The first fan transfers the air received from one or more ducts to one or more second fans. This defines the first air flow path inside the outdoor unit. The electronic component section or the second section comprises of one or more vents and one or more louvers to aid in air flow and ventilation inside the control box. There is a second air flow path associated with the control box of the outdoor unit where the one or more vents are configured to receive air from the one or more air ducts associated with the first section. The air through the air vents is transferred to the one or more louvers. The air through one or more louvers is transferred to one or more second fans or condenser fans. In the third air flow path, air from the one one or more ducts is transferred to one or more vents. The air from the one or more vents is transferred to the first fan from where the air is further transferred to the one or more second fans. The one or more second fans are associated with the third section or the outdoor section having an exhaust function. This outer section expels out the air received from the first section and the second section lowering the temperature inside the control box of the outdoor unit.

In an embodiment of the invention, the first fan associated with the first section may be a heat sink fan. The heat sink fan is designed such that the air received from the one or more ducts, one or more vents, and the louvers is directed towards the one or more second fans or condenser fans. The one or more second fans are designed to expel the hot air received from the one or more ducts, one or more vents, and the louvers to external environment.

It is to be noted that the number of air vents, air ducts, and the louvers described herein are exemplary and can be modified in terms of numbers and design according to the needs of the ventilation inside and electrical equipment. Further, the positions of air vents, air ducts, and the louvers described herein may also be modified according to the needs.

In order to comprehend the invention better, the invention may be understood in terms of the path of the air flow. The air flow path may further be trifurcated into three paths—a first air flow path is followed by the air in the first section corresponding to the heat sink and a second path is followed by the air in the second section corresponding to the electronic components section. In the heat sink section, the heat sink fan may pull air having ambient temperature through the one or more ducts present at the lower end of the outdoor unit for cooling the heat sink. The warm or hot air may then be taken up by the one or more second fans or the condenser fans and may be expelled out from the unit thereby reducing the heat sink temperature significantly. For cooling the electronic components section, the electronic components section may be provided with one or more louvers on one or both the sides of the electronic component section as well as one or more air vents in the bottom side of the electronic components section. The air may be introduced inside the control box through the one or more air ducts and may flow through the one or more air vents. The air from the vents may then be transferred to the one or more louvers situated on the sides of the electronic component section. The air from the one or more louvers may be pulled by the one or more second fans or the condenser fans thereby defining a second air flow path. Further, the air from the one or more vents is directed to the heat sink fan which in turn transfers the hot air from the electronic components section to the one or more second fans. The hot or warm air may then be ejected by the one or more second fans or the condenser fans into the surroundings. This may be referred to as a third air flow path. This flow of air as described may provide for better circulation and ventilation inside the control box thereby promoting cooling of the electronic components as well as the enclosed space inside the control box. However, the flow of air as described is exemplary and may be modified in accordance with the design of the components which is within the scope of the invention.

According to an exemplary embodiment of the invention, provision of louvers and air vents brings about a drastic reduction in the inside temperature of the control box. The temperature within two control boxes, one having the louvers and air vents and the other not having the louvers and air vents was compared and the results are as depicted in Table 1.

TABLE 1

| Test No. | | | 1 | 2 | 3 | 4 | 5 |
|---|---|---|---|---|---|---|---|
| Test Conditions | | Outdoor DBT (° C.) | 35 | 43 | 46 | 46 | 50 |
| | | Indoor DBT/WBT (° C.) | 27/19 | 35/24 | 35/24 | 35/24 | 27/19 |
| | | Input voltage (Volt) (Phase -N) | 230 | 230 | 253 | 195 | 230 |
| | | Input voltage (Volt) (Phase -Phase) | 400 | 400 | 440 | 340 | 400 |
| Test results | Inside temperature of the control box | Without louvers & air vents | 61 | 77 | 74 | 77 | 82 |
| | | With louvers & air vents | 48 | 59 | 61 | 61 | 64 |
| Temperature reduction in % | | | 21% | 24% | 18% | 21% | 22% |

As depicted in Table 1, the temperature inside the control box having louvers and air vents was observed to be 18-24% lower than that of the control box without louvers and air vents. That is, under the test conditions where the external temperature in accordance with Dry Bulb Temperature (DBT) was 35° C. and indoor Dry Bulb Temperature (DBT)/Wet Bulb temperature (WBT) was 27/19° C., the temperature inside the control box (first section and the second section) without louvers and air vents was found to be 61° C. However, when the air vents and the louvers were introduced in the control box, the temperature inside the control box was 48° C. Accordingly, there is a significant reduction of the temperature inside the control box when the features of the invention are incorporated. Similarly, when the outside temperature (DBT) was 43° C. and indoor temperature DBT/WBT was 35/24° C., the temperature inside the control box having the air vents and the louvers was 59° C. as compared to the temperature of 77° C. inside the control box without the louvers and the air vents. Likewise, a 13° C. and a 16° C. reduction in temperature was observed on using the control box of the present invention when the external temperature was 46° C. and indoor DBT/WBT was 35/24° C. Also, a drastic reduction in the temperature inside the control box from 82° C. to 64° C. was detected on using the control box designed as per the present invention as compared to the conventional control box lacking the louvers and the air vents.

It is noted that for external air temperature Dry Bulb Temperature is measure and indoor temperature is measured both in terms of Dry Bulb Temperature and Wet Bulb Temperature.

FIG. 1 depicts an exemplary outdoor unit 100 for providing adequate cooling inside control box of an electrical equipment. In an exemplary embodiment, the outdoor unit has three different sections—a first section, a second section, a third section corresponding to a heat sink section, an electronic component section and an outdoor section, respectively. In the first section are provided, one or more air ducts 102 for drawing ambient temperature air from the surroundings and a first fan or a heat sink fan 108 behind the electronic component section. The air ducts may be round, circular, square, rectangular, triangular or of any other shape known in the art that can provide for supply and removal of air. The second section corresponding to the electronic components section comprises one or more louvers 106 present on one or both the side walls of the electronic component section. The louvers may be present on all or any dimension of the electronic components section. In the exemplary embodiment, the air vents 104 may be situated in the bottom side of the electronic components section but not limited thereto. According to an embodiment of the invention, the louvers may be a set of angled slats, horizontal drainable blades or any other such opening obvious to a person skilled in the art for allowing air to pass through. The second section may be covered by a cover plate (not shown) for avoiding dust and dirt from outside environment. The third section or the outdoor section comprises of one or more second fans or condenser fans 110 that serve to exhaust warm or hot air from the inside of the control box. The air having ambient temperature may be drawn inside the outdoor unit 100 through the air ducts 102 and circulated within the control box through the louvers 106 and air vents 104. The warm or hot air may be taken up by the heat sink fan 108 and expelled out of the control box by way of condenser fans 110 to bring about a drastic reduction in the temperature of the heat sink as well as the electronic components.

Figure 1A:
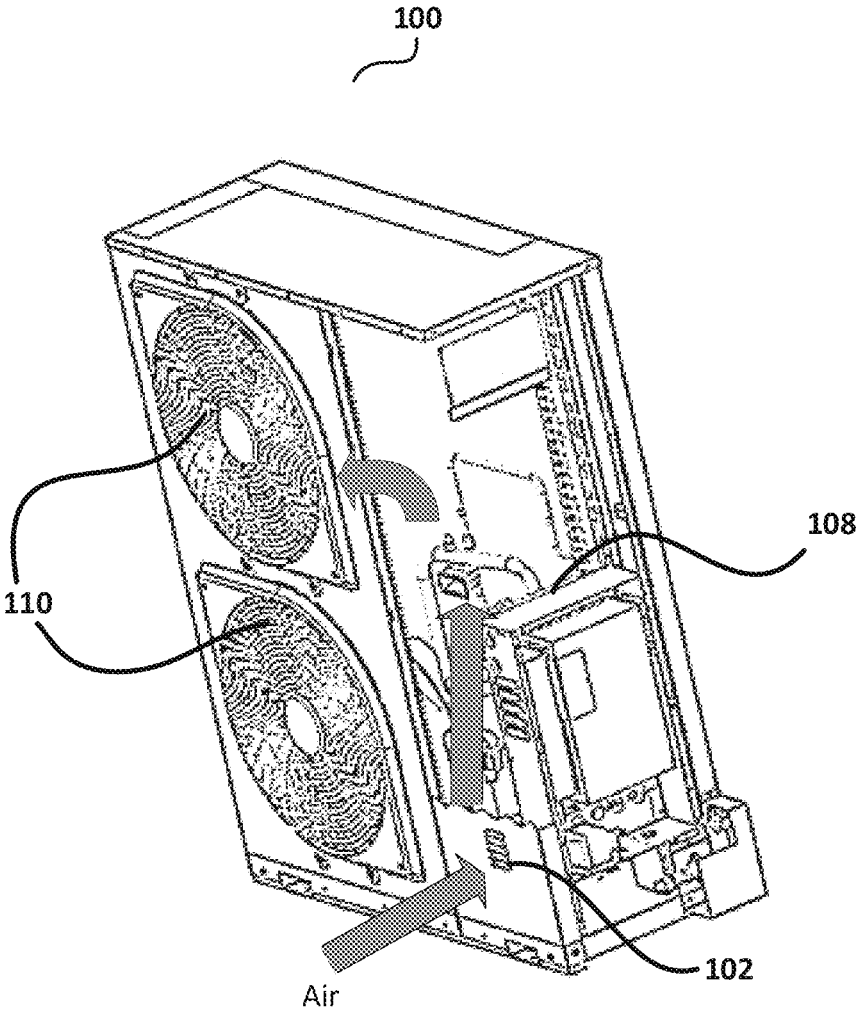
FIG. 1A is an exemplary diagram depicting an outdoor unit showing flow of a first air flow path in accordance with an exemplary embodiment of the invention.

FIG. 1A depicts an exemplary embodiment illustrating a first air flow path in the control box of the outdoor unit. The air enters through one or more ducts 102 and air air is then transferred to the first fan 108. The air from the first fan 108 is further transferred to the one or more second fans or condenser fans 110.

Figure 1B:
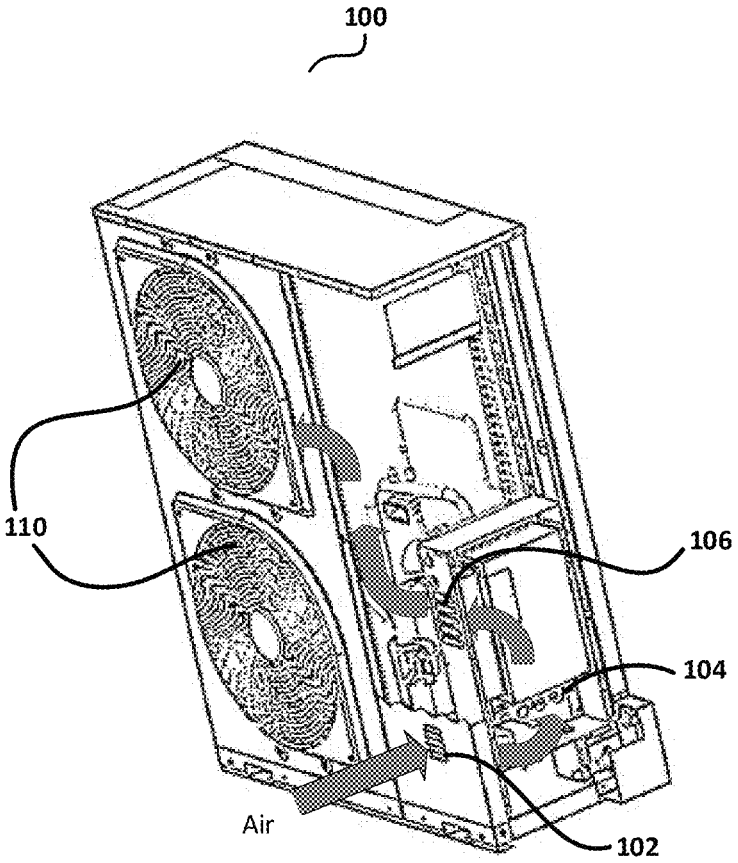
FIG. 1B is an exemplary diagram depicting an outdoor unit showing flow of a second air flow path in accordance with an exemplary embodiment of the invention.

FIG. 1B depicts an exemplary embodiment illustrating a second air flow path in the control box of the outdoor unit. Air enters through one or more ducts 102. Air from the done or more ducts is received by one or more vents. From the one or more vents, the air is transferred to one or more louvers 106. Air fro the one or more louvers is expelled by the one or more second fans or condenser fans 110.

Figure 1C:
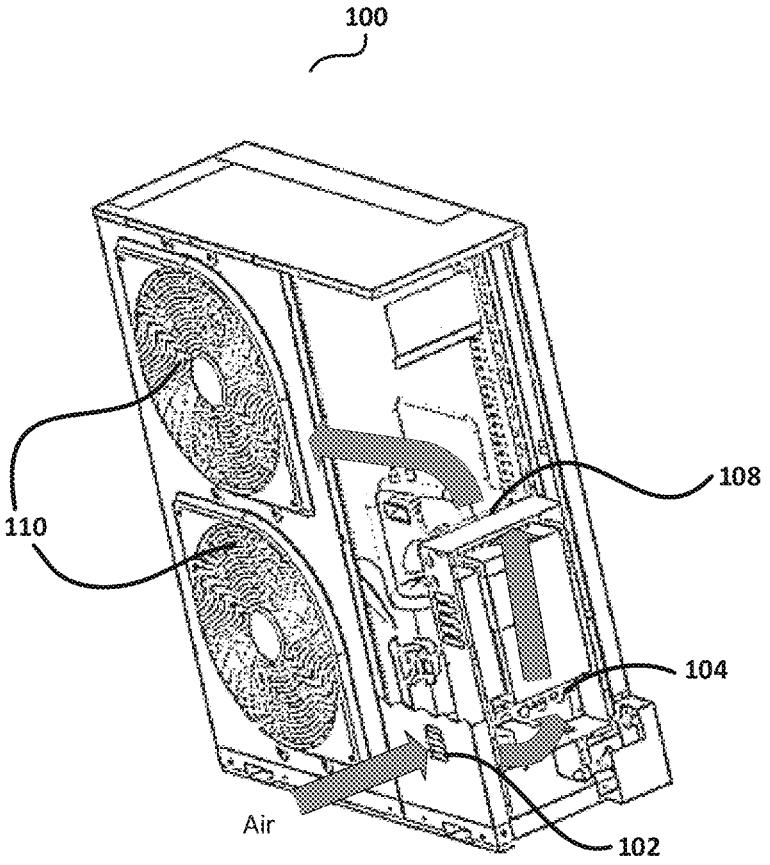
FIG. 1C is an exemplary diagram depicting an outdoor unit showing flow of a third air flow path in accordance with an exemplary embodiment of the invention.

FIG. 1C depicts an exemplary embodiment illustrating a second air flow path in the control box of the outdoor unit. Air enters through one or more ducts 102. The air from the one or more ducts is received by the one or more vents 104. Air from the one or more vents 104 is transferred to th first fan 108. Air is then expelled out of the outdoor unit through one or more second fans 110.

Figure 2:
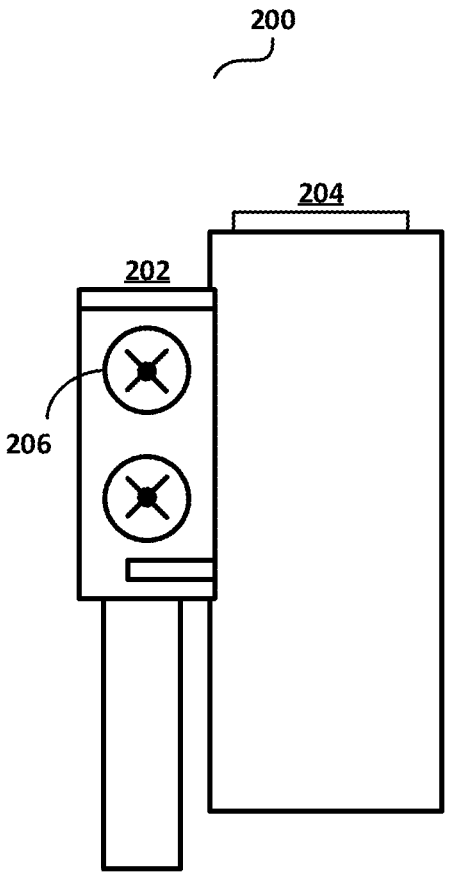
FIG. 2 is an exemplary diagram of a control box of an outdoor unit depicting the different sections in accordance with an exemplary embodiment of the invention.

FIG. 2 is an exemplary diagram of a control box 200 of an outdoor unit depicting the different sections in accordance with an exemplary embodiment of the invention. The control box 200 may comprise of a first section corresponding to the heat sink section 202 and a second section 204 corresponding to the electronic components section. The figure also depicts the control box having one or more first fans 206. The heat generated in the heat sink section 202 and the electronic component section 204 due to the working of an equipment may be expelled out from the control box comprising of one or more second fans or condenser fans 206.

Figure 3:
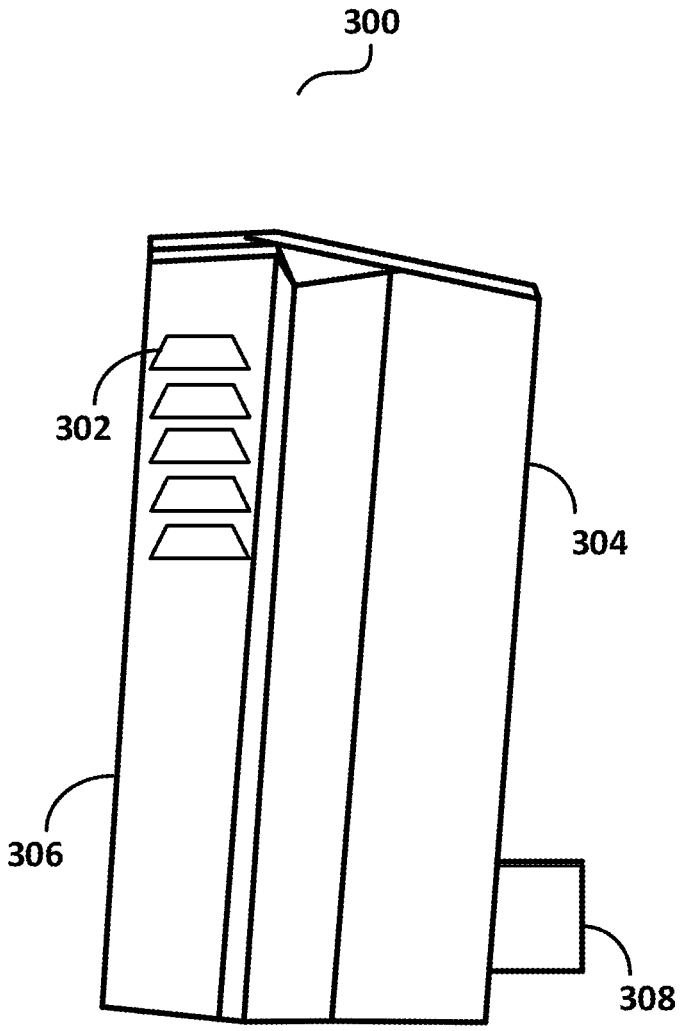
FIG. 3 is an exemplary diagram depicting the external view of a control box in accordance with another exemplary embodiment of the invention.

FIG. 3 is an exemplary diagram depicting the external view of a control box 300 in accordance with another exemplary embodiment of the invention. In the control box 300 are encapsulated the first section or the heat sink section 304 and the second section or the electronic component section 306. The heat sink section 304 may be provided with an air duct 308 for letting in air from outside having ambient temperature. The electronic component section 306 may have one or more louvers 302 to provide for circulation of air within the second section of the control box 300.

Figure 4:
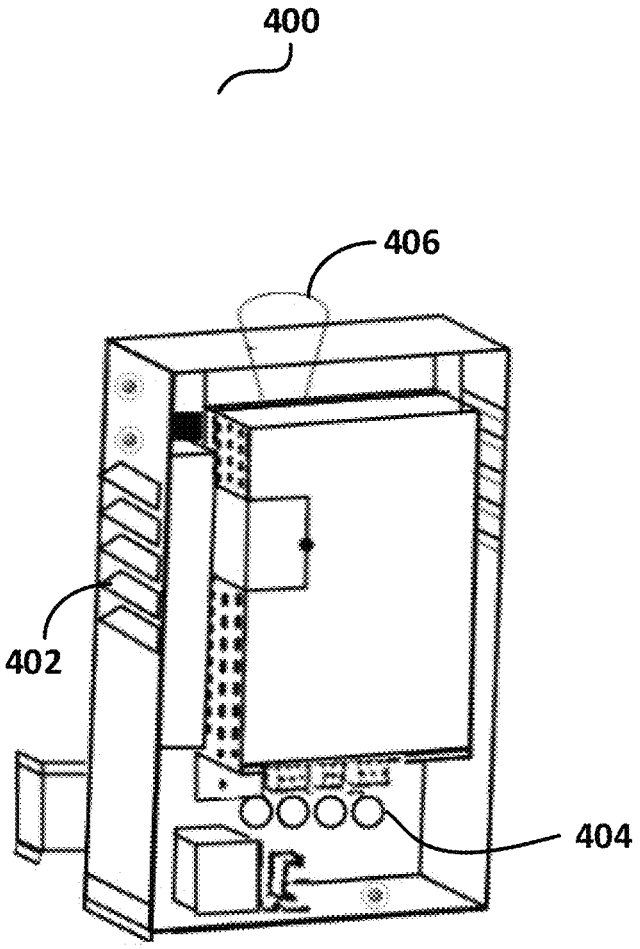
FIG. 4 is an exemplary diagram depicting the electronic component section according to an exemplary embodiment of the invention.

FIG. 4 is an exemplary diagram depicting the electronic component section 400 according to an exemplary embodiment of the invention. The electronic component 400 may be provided with one or more louvers 402 on the sides. One or more air vents 404 are provided towards the bottom of the electronic component section 400 to aid in circulation of air thereby drastically reducing the temperature of the electronic components present in the electronic components section 400. As discussed above, the first section or the heat sink section of the outdoor unit may be enclosed with the second section or the electronic component section in a control box, i.e., both the units may be present adjacent to each other. In FIG. 4 it is depicted that a first fan or a heat sink fan 406 may be associated with the first section or the heat sink section. The first fan or the heat sink fan 406 may be present behind the electronic component 400.

It is understood that in the exemplary embodiment, the number of air vents are numbered as 4. In another embodiment of the invention, the number of vents may vary from 4-8. However, the size and the number of vents may vary depending upon the application. Further, it is seen that louvers are present on two sides of the electronic components section. However, the louvers may also vary depending upon the application.

Figure 5:
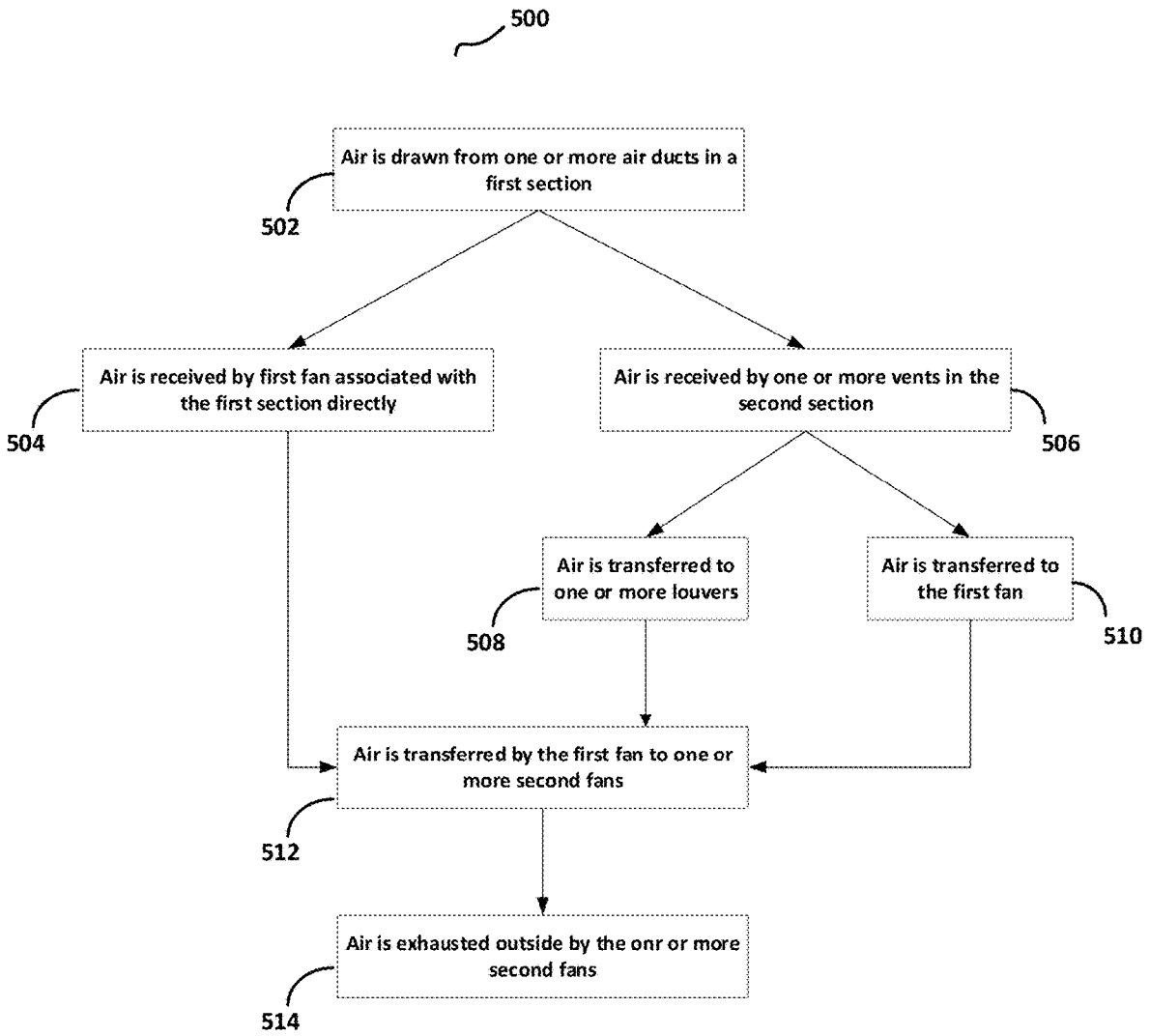
FIG. 5 is an exemplary flowchart illustrating a method to perform the invention according to an exemplary embodiment of the invention.

FIG. 5 depicts a flowchart illustrating a method to perform the invention according to an exemplary embodiment of the invention. The method flowchart 500 describes a method being performed for enabling the invention. The method may start at step 502. At step 502, the air may be drawn inside the outdoor unit 100 from one or more air ducts 102 in a first section, the first section being coupled with the one or more air ducts 102. At step 504, the air may be received by a first fan 108 associated with the first section directly. At step 506, the air may also be received by the one or more vents 104 in a second section from the one or more air ducts 102 in the first section. At step 508, the air may be transferred to one or more louvers 106 and the first fan 108. At step 510, the air is transferred to one or more second fans 110 by the first fan 108 and the one or more louvers 106. At step 512, the hot air is exhausted out of the outdoor unit 100 by the one or more second fans 110. The method step may end at 512.

The present invention is applicable to any electrical equipment known in the art that has a fan within it and that requires cooling of electronic components present within the equipment.

The present invention provides for the following technical advantages over the existing methods and solutions where a lot of heat is generated within a control box of electrical equipment affecting the life as well as the performance of the equipment: a) reduces the temperature within the enclosed space of the control box by lowers the temperature of electronic components and the heat sink; b) increases the life of electronic components of the electrical equipment; c) avoids failure and/or malfunctioning of electrical equipments; d) prevents power trips occurring due to high heat sink temperature and e) enhances system reliability.

The embodiments of the invention and the table discussed herein are exemplary and various modification and alterations to a person skilled in the art are within the scope of the invention.

The order of execution or performance of the operations in examples of the invention illustrated and described herein is not essential, unless otherwise specified. That is, the operations may be performed in any order, unless otherwise specified, and examples of the invention may include additional or fewer operations than those disclosed herein. For example, it is contemplated that executing or performing a particular operation before, contemporaneously with, or after another operation is within the scope of aspects of the invention.

When introducing elements of aspects of the invention or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of."

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

What is claimed is:

1. An outdoor unit comprising:

a first section and a second section;

the first section coupled with one or more air ducts to provide air to a first fan associated with the first section, wherein the first fan transfers the air to one or more second fans, the one or more air ducts, the first fan and the one or more second fans defining a first airflow path;

the second section comprising one or more vents and one or more louvers, the one or more vents configured to receive air from the one or more air ducts associated with the first section, wherein the air through the one or more vents is transferred to the one or more louvers and to the one or more second fans along a second airflow path, wherein the air through the one or more vents is transferred to the first fan and is further transferred to the one or more second fans along a third airflow path.

2. The outdoor unit of claim 1, wherein the first section corresponds to a heat sink and the second section corresponds to electronic components of the outdoor unit.

3. The outdoor unit of claim 1, wherein the first section and the second section are encapsulated inside a box of the outdoor unit.

4. The outdoor unit of claim 1, wherein the one or more air ducts receive an ambient air from the environment.

5. The outdoor unit of claim 1, wherein the one or more vents in the second section comprise four vents.

6. The outdoor unit of claim 1, wherein the one or more louvers are present on two sides of the second section.

7. The outdoor unit of claim 1, wherein the second section is covered by a cover plate.

8. The outdoor unit of claim 1, wherein the one or more air ducts are present at the lower end of the outdoor unit.

9. The outdoor unit of claim 1, wherein the one or more second fans are associated with a third section of the outdoor unit.

10. The outdoor unit of claim 9, wherein the third section corresponds to an outdoor section for expelling out the air received from the first section and the second section.

11. The outdoor unit of claim 10, wherein the expelling the air from the third section lowers temperature inside the first section and the second section of the outdoor unit.

12. A method comprising:

receiving air from one or more air ducts in a first section, the first section coupled with the one or more air ducts;

along a first airflow path, providing the air to a first fan associated with the first section and transferring the air by the first fan to one or more second fans;

receiving the air from the one or more air ducts associated with the first section to one or more vents in a second section;

along a second airflow path, providing the air through the one or more vents to the one or more louvers and then to the one or more second fans; and along a third airflow path, providing air through the one or more vents to the first fan and then to the one or more second fans.

13. The method of claim 12, wherein the air duct receives an ambient air from the environment.

14. The method of claim 12, wherein the one or more vents in the second section comprise four vents.

15. The method of claim 12, wherein the one or more louvers are present on two sides of the second section.

16. The method of claim 12, wherein the first section corresponds to a heat sink and the second section corresponds to electronic components of an outdoor unit.

17. The method of claim 16, wherein the one or more second fans are associated with a third section of the outdoor unit.

18. The method of claim 17, wherein the third section corresponds to an outdoor section for expelling out the air received from the first section and the second section.

19. The method of claim 18, wherein the expelling the air from the third section lowers temperature inside the first section and the second section of the outdoor unit.

20. The method of claim 19, wherein the first section and the second section are encapsulated inside a box of the outdoor unit.

* * * * *